US005362160A

United States Patent [19]

Braun et al.

[11] Patent Number: 5,362,160

[45] **Date of Patent: * Nov. 8, 1994**

[54] SUPPORTING DISK

[75] Inventors: Otmar Braun, Frielendorf; Herbert Schumacher, Gorxheimer Tal, both of Germany

[73] Assignee: Firma Carl Freudenberg, Weinheim, Germany

[ * ] Notice: The portion of the term of this patent subsequent to Jun. 22, 2010 has been disclaimed.

[21] Appl. No.: 934,141

[22] Filed: Aug. 24, 1992

[30] Foreign Application Priority Data

Nov. 8, 1991 [DE] Germany ..... 4136793

[51] Int. Cl.[5] ..... F16C 33/34

[52] U.S. Cl. ..... 384/549; 57/406; 57/407

[58] Field of Search ..... 384/549, 565, 909; 57/406, 407

[56] References Cited

U.S. PATENT DOCUMENTS

| | | | |
|---|---|---|---|
| 4,890,942 | 1/1990 | Raasch | 384/549 |
| 4,893,946 | 1/1990 | Tesh et al. | 384/549 |
| 4,893,947 | 1/1990 | Hurley | 384/549 |
| 5,221,133 | 6/1993 | Braun et al. | 57/406 |

*Primary Examiner*—Lenard A. Footland
*Attorney, Agent, or Firm*—Kenyon & Kenyon

[57] ABSTRACT

A supporting disk for a flywheel of an open-end spinning machine, comprising a hub ring (1) and a support ring (3) made of elastomer material and affixed to the outer surface of the hub ring. The hub ring (1) consists of a polymer material with a modulus of elasticity of 7000 to 13000N/mm$^2$, a dimensional stability to heat from 150° to 250° C., as well as an elongation at break of 1.3 to 3%.

14 Claims, 3 Drawing Sheets

SUPPORTING DISK

BACKGROUND OF THE INVENTION

The present invention relates to a supporting disk for a flywheel of an open-end spinning machine, and in particular to a supporting disk for a flywheel of an open ended spinning machine operating at high rotational velocities.

While such supporting disks are known, they are quite expensive and machining the associated hub ring is expensive as well. Typically, several grooves running along the circumference of the hub ring must be machine-cut on a lathe so that the support ring may be affixed to the hub ring. The machined grooves are subsequently thoroughly degreased and then treated to enable the elastomer polyurethane support ring to be secured to the outer surface and reliably retained there during normal operational use. Therefore, from a standpoint of production engineering, a great deal of time is needed to manufacture conventional supporting disks, because of the machining steps required.

The object of the present invention is to provide a supporting disk of the type mentioned at the outset which is capable of being manufactured in a simpler, faster, and much less expensive manner and which will provide a good rotational symmetry.

SUMMARY OF THE INVENTION

The present invention solves this objective by providing a supporting disk for a flywheel rotating about a drive-shaft of an open-end spinning machine having a hub ring and a support ring. The hub ring, has an outer radial surface area and consists of a polymer material having a modulus of elasticity of 7000 to 13000N/mm$^2$, dimensional stability to heat from 150° to 250° C., and an elongation at break of 1.3 to 3%. The support ring is made of elastomer material and has an inner radial surface area. The inner radial surface area is affixed to the outer radial surface area of the hub ring.

Further, the outer radial surface area of the hub ring has an I-shaped profile and the inner radial surface area of the support ring has a U-shaped profile which includes lateral sides. The lateral sides project radially inward such that the U-shaped profile of the support ring mates with both sides of the I-shaped profile of the hub ring.

The hub ring of the supporting disk according to the present invention consists of a polymer material with a modulus of elasticity of 7000 to 13000N/mm$^2$, a dimensional stability to heat from 150° to 250° C., as well as an elongation at break of 1.3 to 3%.

In the supporting disk of the present invention, the support ring and the hub ring form an inseparable unit. This unit can be produced easily and cost-effectively on a commercial scale and is very well suited for meeting the above-required conditions. The unit is distinguished from conventional units by its excellent dimensional stability. This dimensional stability permits the hub ring to be reliably secured to a shaft even after long-term use. For the most part, secondary auxiliary devices are not needed, so that simply pressing the hub ring axially on to the shaft is sufficient. Of course, secondary shaft-hub connections, such as spline profiles or spline-shaft connections, can also be applied.

Since the hub ring is made of polymer material, there is no need to fear hub ring damage, even when the shaft is made of steel and the hub ring is pressed on.

When elastomer polyurethane is used to manufacture the support ring, the support ring is particularly resistant to abrasion and, in addition, provides a damping action that is suited to the application case. Thus, an excellent service life is attained.

The hub ring can have an I-shaped profile in the area of its outer, radial boundary edge, and the support ring can have a U-shaped profile in the area of its inner, radial boundary edge such that the U-shaped profile of the support ring embraces the hub ring on both sides with lateral sides that project radially to the inside. As a result, the contact surface of the hub ring is enlarged relative to the support ring which considerably improves the adhesion of the two rings. By this means, deformation changes in the support ring caused by centrifugal force are compensated for effectively.

The radial joint face of the I-shaped profile of the hub ring may advantageously be penetrated by perforations that are uniformly distributed in the circumferential direction. The lateral sides of the profile of the support ring then may be joined via the perforations. As a result of this configuration, the hub ring and the support ring are secured to one another with a positive fit. This positive fit virtually eliminates any separation of the support ring from the hub, even under unfavorable operating conditions.

Applying polyurea (e.g., formaldehyde urea) has proven to be favorable in the manufacturing of hub rings. Not only does it have a modulus of elasticity of 7000 to 13000N/mm$^2$, a dimensional stability to heat from 150° to 250°, and an elongation at break of 1.3 to 3%, but it also provides a good adhesive base for the polyurethane and costly preparatory treatment is avoided. Thus, the supporting disk of the present invention may be manufactured in an economically efficient manner.

In a further embodiment, the hub ring can have a signal transmitter in at least one subsection of its axial boundary surfaces. To avoid any manifestation of unbalance, the signal transmitter preferably consists of a light-reflecting foil adhered to the hub ring. Such a signal transmitter permits rotational speed of the supporting disk to be monitored and subsequently regulated in a simple manner. The signal sensor can be connected, for example, through signal transmission via a control element to the driving mechanism of the supporting disk. This significantly facilitates regulating the rotational speed of the supporting disk.

To accommodate the conditions of special applications, the hub ring can be provided with at least one retaining claw in the area of its inner circumference. The retaining claw may be movable in the radial direction such that the hub may be secured onto the shaft by means of the retaining claw snapping into a groove of an applied drive shaft, which opens radially to the outside. As a result, the axial positioning of the supporting disk on the drive shaft is particularly simple.

Moreover, in the area of its inner circumference, the hub ring can have at least one groove, which is configured at right angles to the circumferential direction and is able to engage with at least one projection of the drive shaft. This refinement, which can also be combined with a retaining claw, for example, provides additional stability to protect the supporting disk on the drive shaft from torsion. Preferably, shaft-hub connections having a spline profile or spline-shaft connections are applied.

BRIEF DESCRIPTION OF THE DRAWINGS

The subject matter of the present invention shall be clarified in greater detail in the following based on the enclosed drawings.

DETAILED DESCRIPTION

In the specification, the term "elongation at break" is the linear deformation of a test object at any one time relative to the original measured length of the test specimen (DIN 53455).

In the specification, the term "modulus of elasticity" is the correlation between strain and elongation in the case of a bar expansion, given an unimpeded reduction in cross-section (DIN 53457).

In the specification, the term "dimensional stability to heat" is the ability of a test specimen to substantially retain its form up to a certain temperature while subjected to a specific stationary load (DIN 53461).

Figure 1:
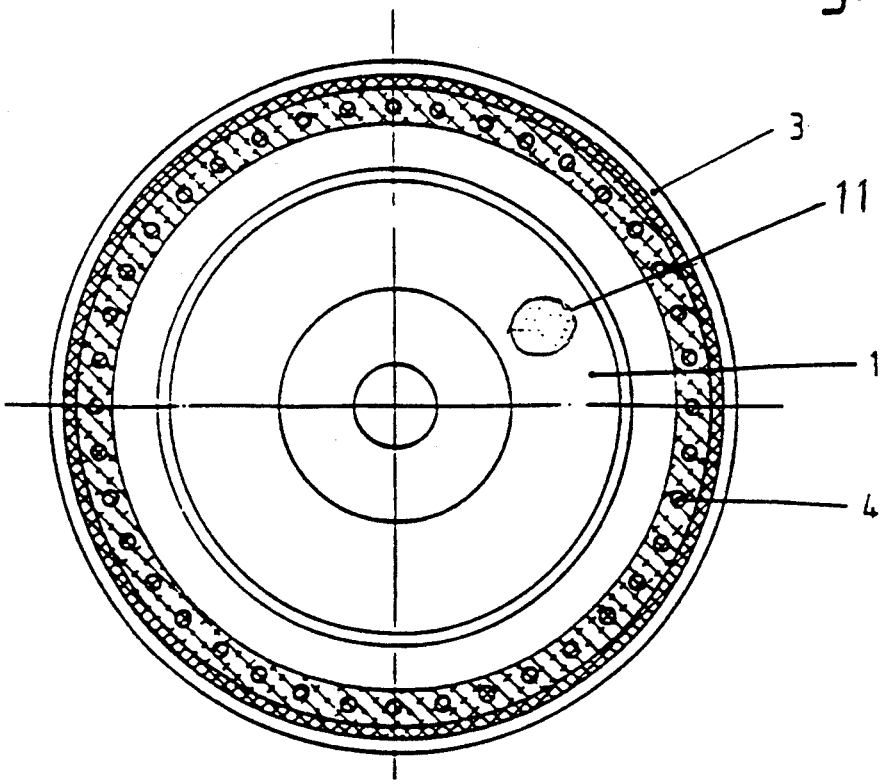
FIG. 1 is a partial front view of a cross sectional representation of a supporting disk.

The supporting disk shown in FIG. 1 is intended to serve as the flywheel of an open-end spinning machine, which can attain rotational speeds of 130,000 rpm.

Figure 2:
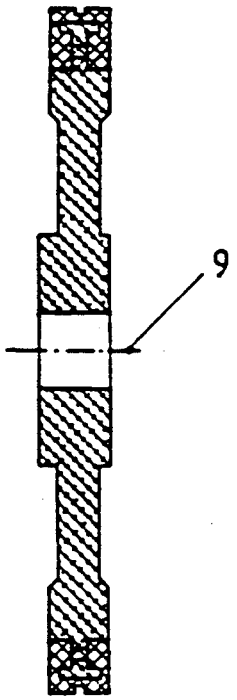
FIG. 2 is a cross-sectional side view of the supporting disk according to FIG. 1.

The supporting disk comprises a hub ring 1 of polymer material, which has a dynamically balanced shape and an I-shaped profile in the radial direction on its outer circumference (see FIG. 2).

In this example, the hub ring 1 is made of polyurea (e.g., formaldehyde urea) and exhibits a modulus of elasticity of 10000N/mm$^2$, a dimensional stability to heat of 200° C., and an elongation at break of 2.5%.

Figure 3:
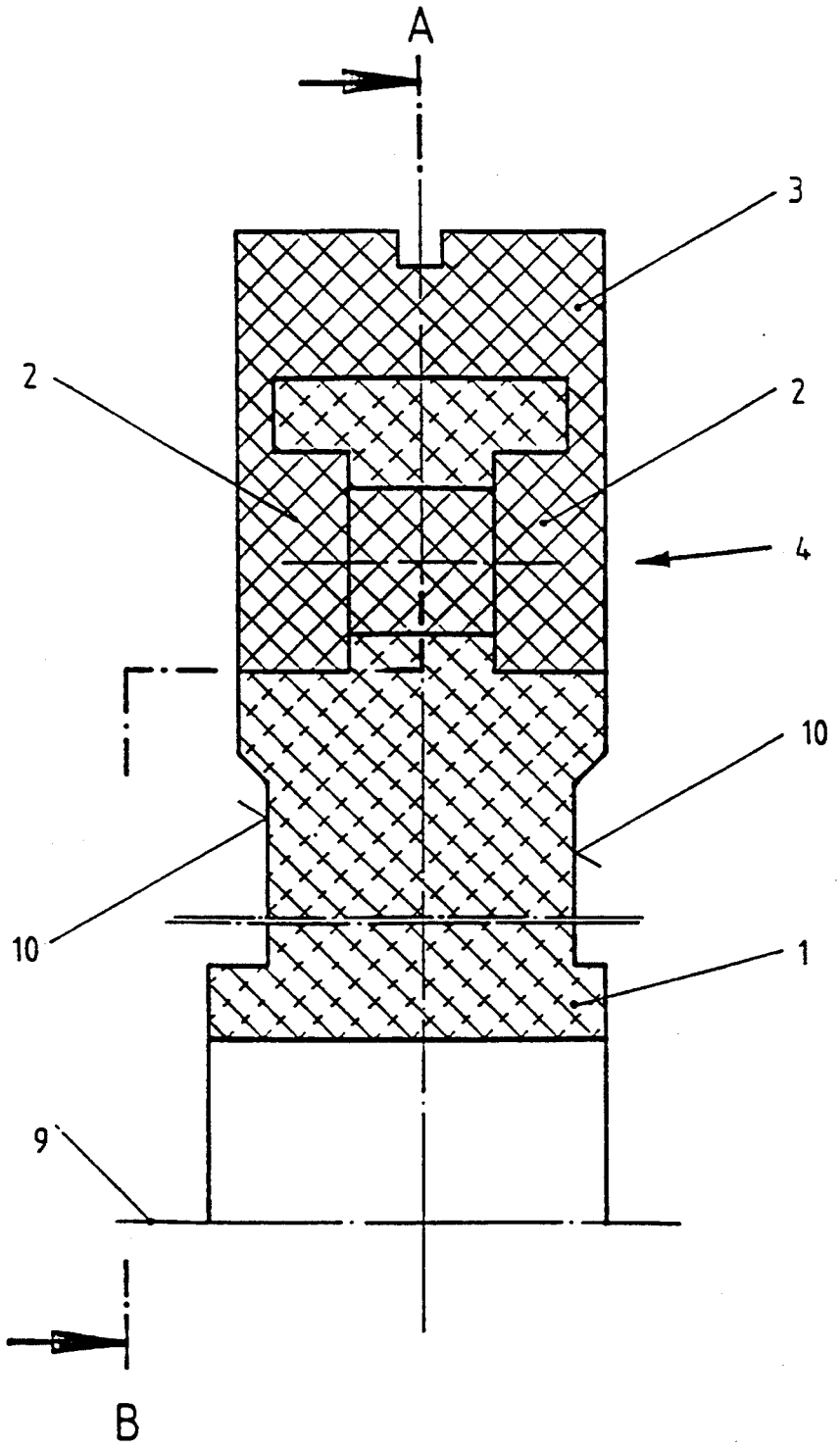
FIG. 3 is an enlarged representation of a cut-away portion of the supporting disk according to FIG. 2.

The hub ring 1 is allocated essentially perpendicularly to the axis of rotation 9 of the supporting disk. It includes perforation 4 axially in the middle area of its I-shaped profile, within the radial extent. The perforations 4 are distributed uniformly in the circumferential direction, in this particular case in the form of bore holes (see FIGS. 1, 3, 4).

The support ring 3 consists of elastomer polyurethane, which is premolded directly on to the hub ring 1. The support ring 3 essentially has a U-shaped profile, which mates with the I-shaped profile of the hub ring 1 with lateral sides 2 that project radially inward.

The lateral sides 2 are joined through the perforations 4 of the hub ring 1, i.e., the lateral sides 2 pass through the perforations 4 so that each of the lateral sides enter into one another. Therefore, the support ring 3 is secured to the hub ring 1 by a reciprocal, positive-fit surrounding, or rather penetration of the profiles (see FIG. 1, FIG. 3) as well as being secured to the hub ring with adhesives. As a result, even at the highest rotational speeds, the centrifugal force will not detach the support ring 3 from the hub ring 1.

Figure 4:
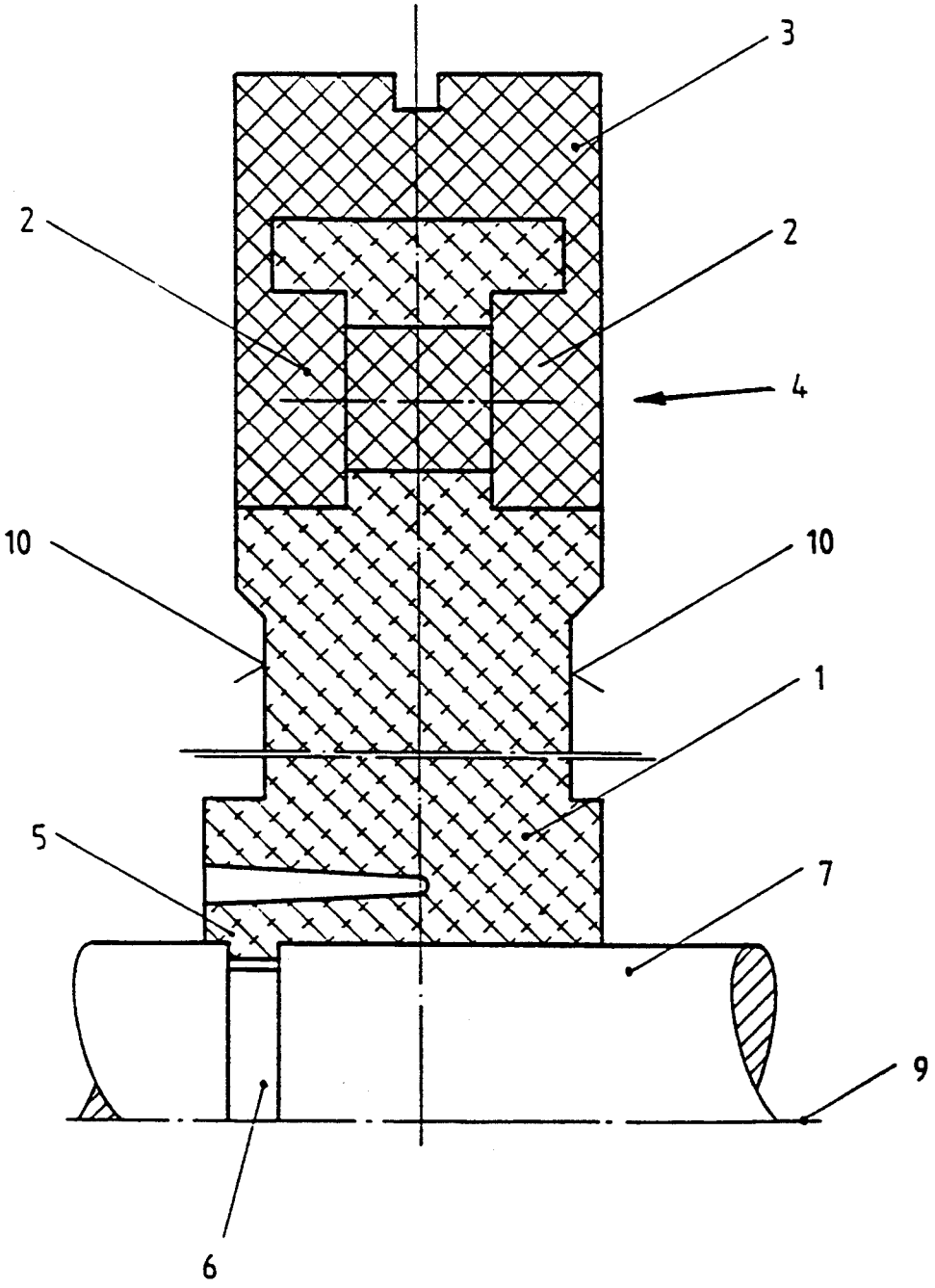
FIG. 4 is a segmental cut-away portion of an alternative specific embodiment of a supporting disk in a front view.

FIG. 4 depicts an alternate embodiment of the present invention in which the hub ring 1 is provided in the area of its inner circumference with a retaining claw 5. The retaining claw 5 is movable in the radial direction and is snapped into place in a groove 6, open radially to the outside, of an applied drive shaft 7. This arrangement simplifies the axial fixing of the hub ring 1 to the drive shaft 7.

In a preferred embodiment, the present invention provides, in addition to the radially movable retaining claw, a hub ring to shaft connection having a polygon-shaped profile or splines. Such a hub ring to shaft connection guarantees additional stability in the circumferential direction.

Besides providing a particularly good, dynamically balanced localization of the support ring 3 on the hub ring 1, the supporting disk according to the present invention is distinguished from conventional support disks by the ease of its production, its low manufacturing costs, its lack of ascertainable manifestations of unbalance over the entire speed range, and overall, therefore, by its good working properties.

In a further embodiment, the hub ring 1 can have a signal transmitter in at least one subsection of its axial boundary surfaces. To avoid any manifestation of unbalance, the signal transmitter preferably consists of a light-reflecting foil 11 adhered to the hub ring (see FIG. 1). Such a signal transmitter permits rotational speed of the supporting disk to be monitored and subsequently regulated in a simple manner. The signal sensor can be connected, for example, through signal transmission via a control element to the driving mechanism of the supporting disk. This significantly facilitates regulating the rotational speed of the supporting disk.

What is claimed is:

1. A supporting disk for a flywheel rotating about a drive-shaft of an open-end spinning machine comprising:

a) a hub ring, said hub ring
  i) having an outer radial surface area, and
  ii) consisting of a polymer material, said polymer material having a modulus of elasticity of 7000 to 13000N/mm$^2$, a dimensional stability to heat from 150° to 250° C., and an elongation at break of 1.3 to 3%; and b) a support ring, said support ring
  i) being made of elastomer material, and
  ii) having an inner radial surface area, said inner radial surface area being affixed to said outer radial surface area of said hub ring.

2. The supporting disk according to claim 1, wherein said outer radial surface area of said hub ring has an I-shaped profile and wherein said inner radial surface area of said support ring has a U-shaped profile, said U-shaped profile including lateral sides, said lateral sides projecting radially inward such that said U-shaped profile of said support ring mates with both sides of said I-shaped profile of said hub ring.

3. The supporting disk according to claim 2, wherein said I-shaped profile of said hub ring includes perforations, said perforations being uniformly distributed in the circumferential direction such that said lateral sides of the U-shaped profile of said support ring meet and join one another via said perforations.

4. The supporting disk according to claim 3 wherein said hub ring is made of polyurea.

5. The supporting disk according to claim 3, wherein said hub ring is made of thermoplastic polyurethane.

6. The supporting disk according to claim 2 wherein said hub ring is made of polyurea.

7. The supporting disk according to claim 2, wherein said hub ring is made of thermoplastic polyurethane.

8. The supporting disk according to claim 1 wherein said hub ring is made of polyurea.

9. The supporting disk according to claim 1, wherein said hub ring is made of thermoplastic polyurethane.

10. The supporting disk according to claim 1, wherein said hub ring has a signal transmitter in at least one subsection of its axial boundary surfaces.

11. The supporting disk according to claim 10, wherein said signal transmitter comprises a light-reflecting foil, said foil being adhered to said hub ring.

12. The supporting disk according to claim 1 further comprising a retaining claw, said retaining claw, i) being provided on said hub ring in the area of its inner circumference, ii) being movable in an arc approximating the radial direction, and iii) being able to be snapped into a groove of said drive shaft, said groove opening radially to the outside of said drive shaft.

13. The supporting disk according to claim 1 further comprising a groove, said groove i) being provided at the inner circumference of the hub ring, ii) being configured at right angles to the circumferential direction, and iii) being able to engage with at least one projection of said drive shaft.

14. A supporting disk for a flywheel rotating about a drive-shaft of an open-end spinning machine comprising:

a) a hub ring, said hub ring having an outer radial surface area, said outer radial surface area of said hub ring having an I-shaped profile that includes perforations that are uniformly distributed in the circumferential direction; and b) a support ring, said support ring having an inner radial surface area, said inner radial surface area having a U-shaped profile, said U-shaped profile including lateral sides, said lateral sides projecting radially inward such that said U-shaped profile of said support ring mates with both sides of said I-shaped profile of said hub ring, and wherein the lateral sides of the U-shaped profile of the support ring meet and join one another via said perforations.

* * * * *